United States Patent [19]

Faimali

[11] Patent Number: 4,964,399

[45] Date of Patent: Oct. 23, 1990

[54] AUTOMATIC CURATIVE HYDROMASSAGE APPARATUS

[76] Inventor: Maria Faimali, Via Camia, 24 -- 29100 Bettola di Piacenza, Piacenza, Italy

[21] Appl. No.: 260,007

[22] Filed: Oct. 19, 1988

[30] Foreign Application Priority Data

Oct. 21, 1987 [IT] Italy ..... 22366 A/87

[51] Int. Cl.[5] ..... A61H 9/00

[52] U.S. Cl. ..... 128/66; 4/615; 4/616

[58] Field of Search ..... 128/66, 38, 51, 52, 128/48-50; 4/607, 610, 615-619, 604

[56] References Cited

U.S. PATENT DOCUMENTS

| | | | |
|---|---|---|---|
| 1,982,509 | 11/1934 | Frank | 128/66 |
| 2,026,981 | 1/1936 | Kahnt | 128/52 |
| 2,730,737 | 1/1956 | Herman | 128/56 |
| 2,877,467 | 3/1959 | Cloud | 4/570 |
| 3,078,484 | 2/1963 | Briggs | 128/66 |
| 3,574,239 | 4/1971 | Sollerud | 4/616 |
| 3,759,286 | 9/1972 | Page | 4/508 |
| 3,768,462 | 10/1973 | Boulard | 128/65 |
| 4,224,700 | 9/1980 | Bloys | 128/66 |
| 4,651,720 | 3/1987 | Baus | 128/66 |
| 4,757,808 | 7/1988 | Effler | 128/66 |

*Primary Examiner*—Edgar S. Burr
*Assistant Examiner*—Huong A. Pham
*Attorney, Agent, or Firm*—Bucknam and Archer

[57] ABSTRACT

The present invention relates to an automatic curative hydromassage apparatus, comprising a sliding carriage which is reciprocately driven in a vertical direction and supports a delivery nozzle duct formed in a closed loop and encompassing the user, a pump being moreover provided arranged in a tank and supplying the delivery nozzle duct.

2 Claims, 6 Drawing Sheets

Fig. 8
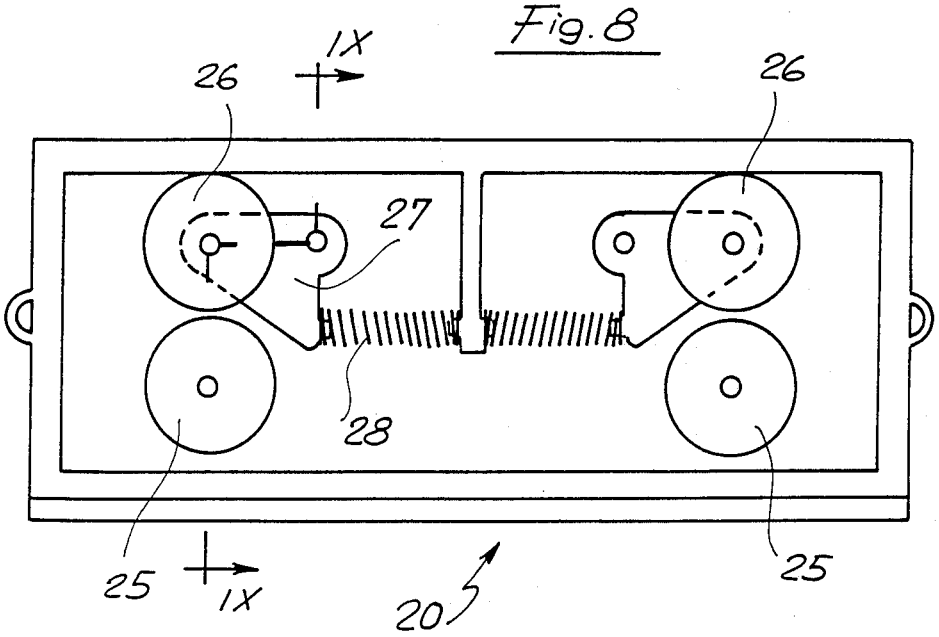
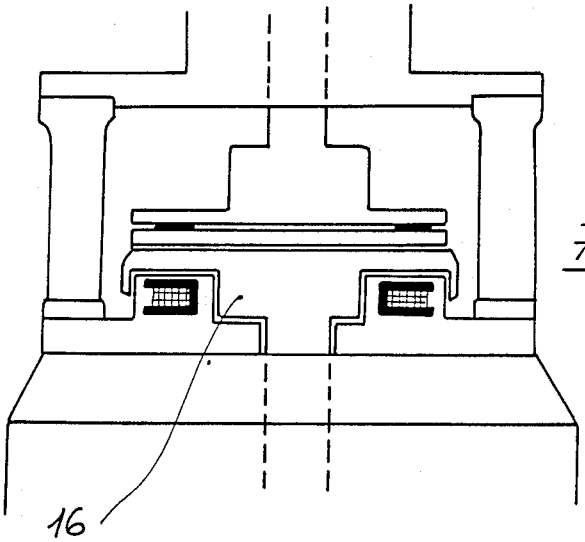
Fig. 5

AUTOMATIC CURATIVE HYDROMASSAGE APPARATUS

BACKGROUND OF THE INVENTION

The present invention relates to an automatic curative hydromassage or hydrofriction apparatus.

As is known, curative hydromassages are generally based on water jets which are suitably caused to impact, in a given direction, against the user body.

Presently available curative hydromassage apparatus, however, are not completely satisfactory since they require frequent manual adjusting operations in order to properly orient the water jet against the body of the user.

Another drawback of known apparatus is that the mechanisms included therein are rather complex construction-wise and, since they are continuously impacted by water jets, they are susceptible to frequent operation malfunctions.

SUMMARY OF THE INVENTION

Accordingly, the main object of the present invention is to provide an automatic curative hydromassage apparatus which comprises a plurality of water delivery nozzles able of impacting against the overall body surface of the user.

Another object of the present invention is to provide an automatic curative hydromassage apparatus which is able of operating in a completely automatic way, without the need of carrying out adjusting operations, while providing a highly efficient hydromassage.

Yet another object of the present invention is to provide such an apparatus which is very simple construction-wise, of very reliable operation, and can be constructed, at a comparatively low cost, starting from easily available elements and materials.

According to one aspect of the present invention, the above mentioned objects, as well as yet other objects, which will become more apparent hereinafter, are achieved by an improved automatic hydromassage apparatus, characterized in that said apparatus comprises a sliding carriage adapted to reciprocate in a vertical direction and supporting a water delivery nozzle duct formed as a closed loop adapted to encompass the user, a pump being moreover provided communicating with a water tank and supplying with water said water delivery nozzle duct.

BRIEF DESCRIPTION OF THE DRAWINGS

Further characteristics and advantages of the present invention will become more apparent hereinafter from the following detailed description of a preferred, though not exclusive, embodiment thereof, which is illustrated, by way of an indicative example, in the accompanying drawings, where:

FIG. 5 is a cross-sectional view taken along the line V—V of FIG. 4;

FIG. 8 is a partial cross-sectional view showing a movable carriage included in the subject apparatus.

DESCRIPTION OF THE PREFERRED EMBODIMENT

Figure 1:
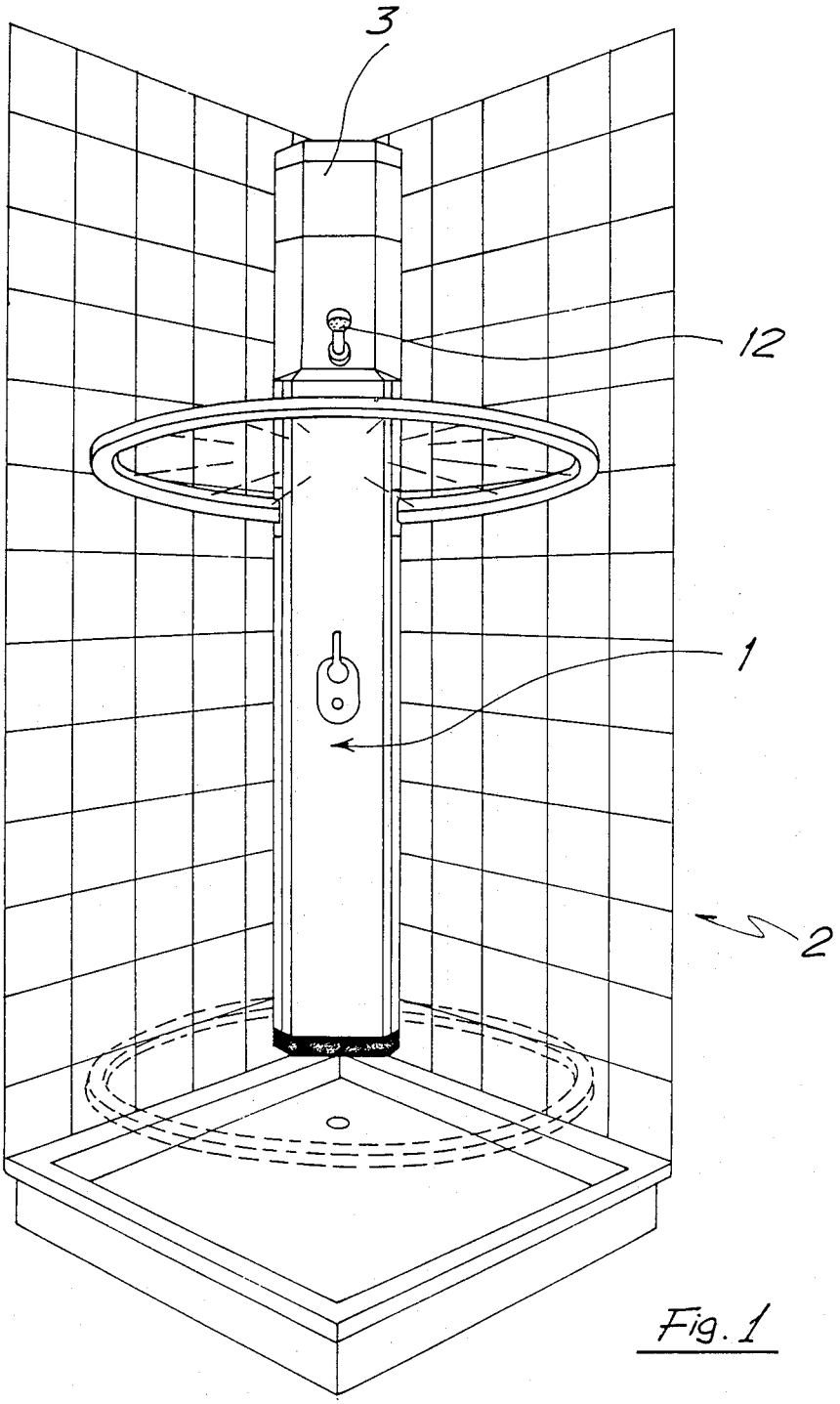
FIG. 1 is a schematic perspective view illustrating the automatic curative hydromassage apparatus according to the invention.

With reference to the figures of the accompanying drawings, the automatic hydromassage apparatus according to the present invention comprises a fixed structure, indicated at the reference number 1, which can be arranged at a corner of a shower-bath room, indicated at the reference number 2.

The fixed structure 1 comprises a water tank 3, arranged at the top, in the inside of which there is provided a float member 4 controlling a microswitch 5 for driving a solenoid valve 6 which, in turn, controls the water supply to the tank 3.

Figure 2:
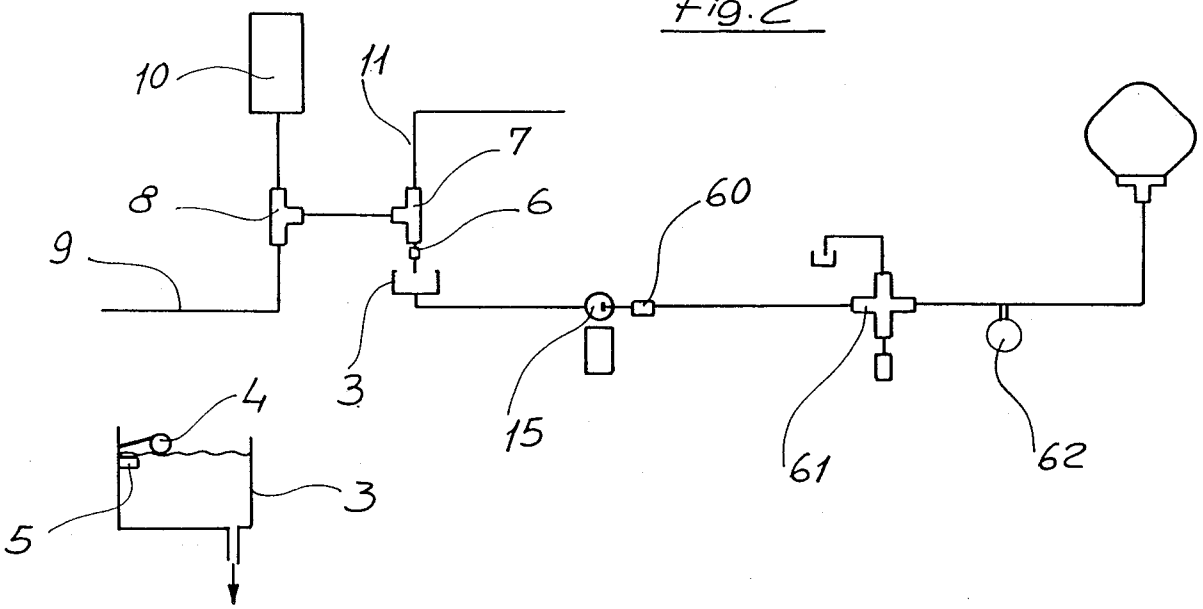
FIG. 2 shows an operation diagram of the apparatus.
Figure 3:
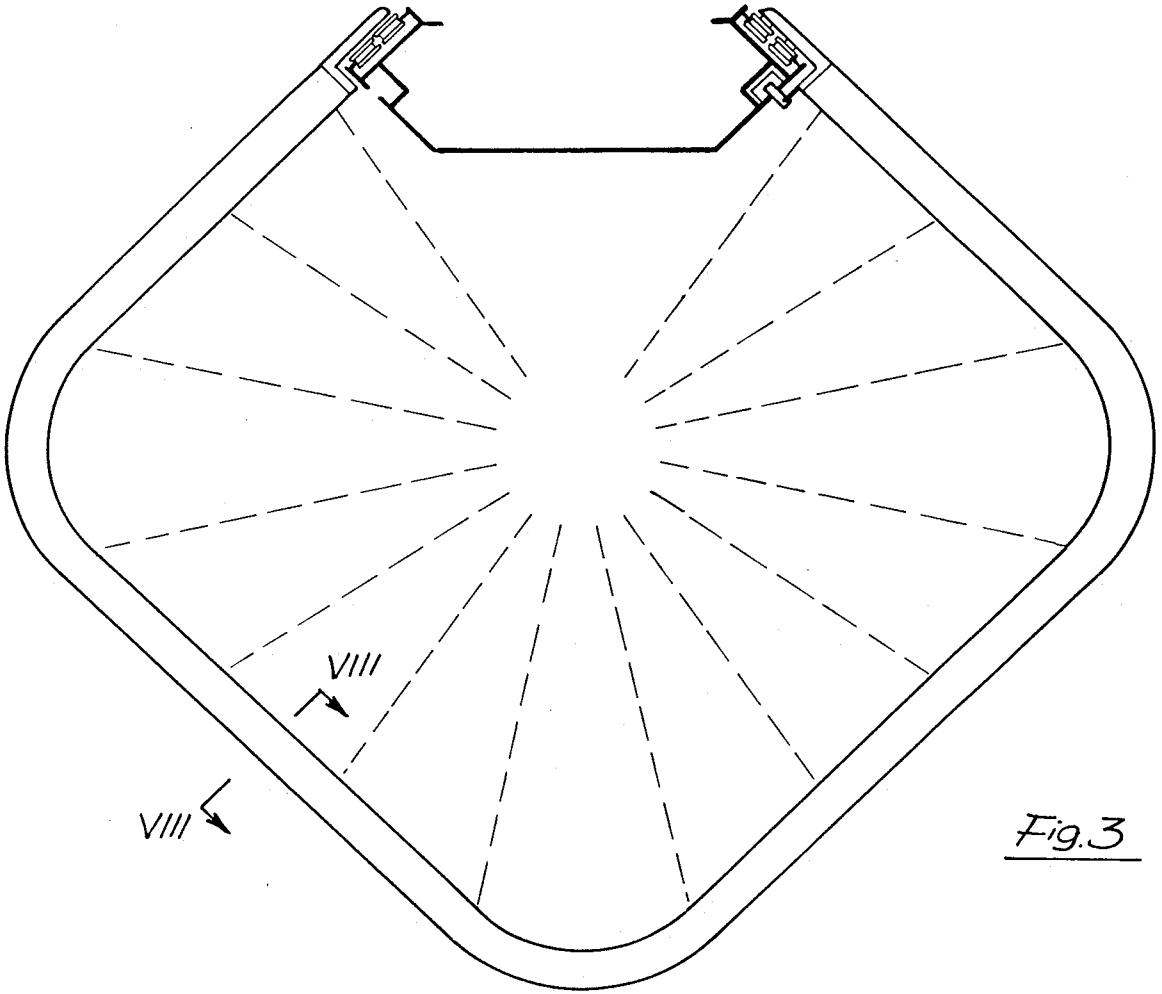
FIG. 3 shows the water delivery nozzle duct of the subject apparatus.
Figure 4:
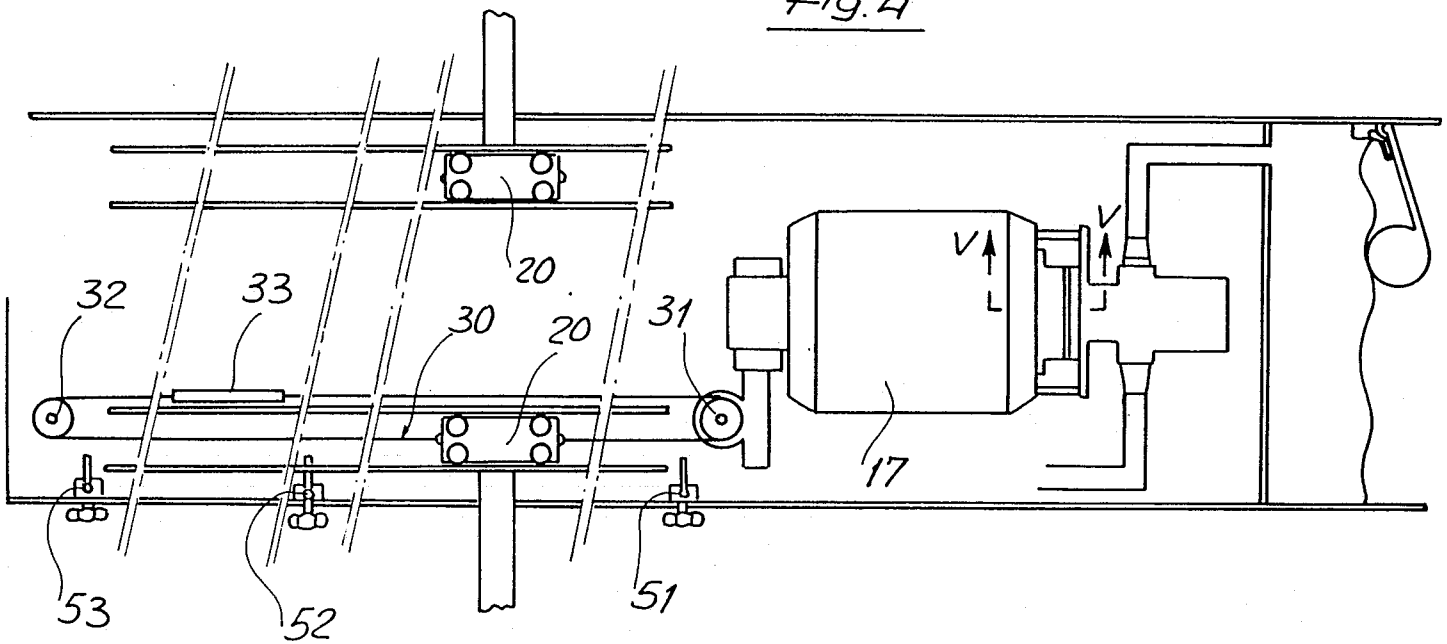
FIG. 4 is another schematic view illustrating the fixed structure of the apparatus.
Figure 6:
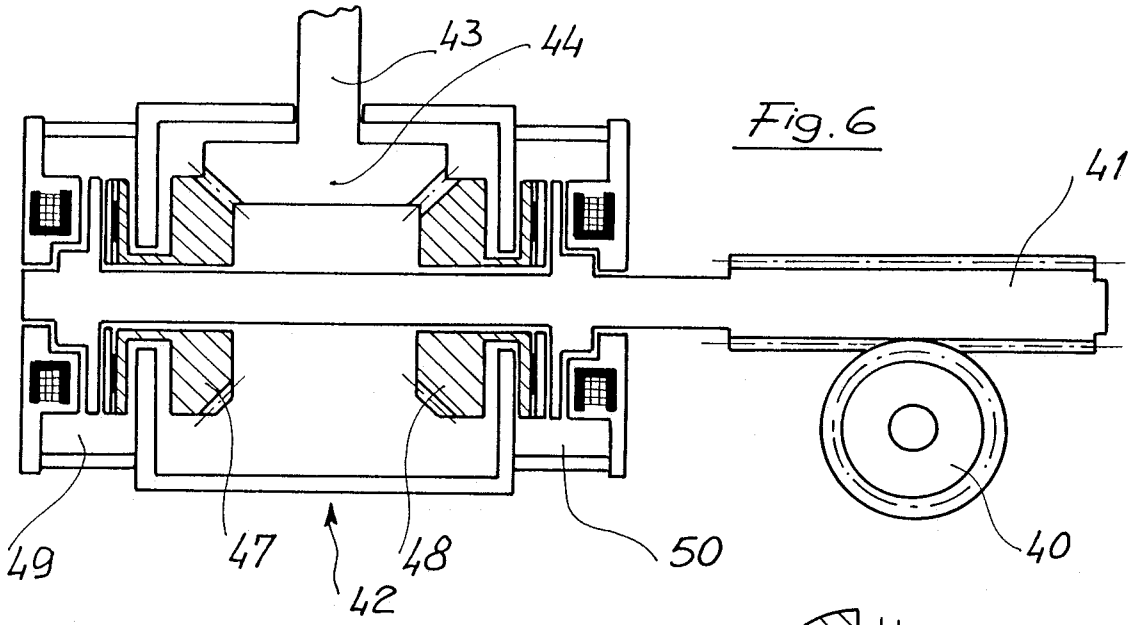
FIG. 6 shows an electromagnetic assembly for performing a vertical reciprocating movement.
Figure 9:
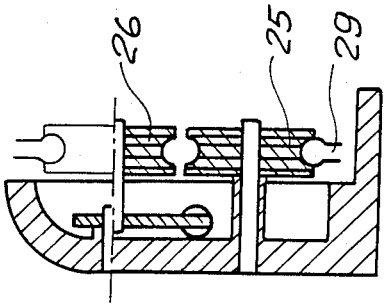
FIG. 9 is a cross-sectional view taken along the line IX—IX of FIG. 8.

As clearly shown in FIG. 2, the solenoid valve 6 is arranged at the output of a switchover member 7 coupled, through a mixer 8, to the hydric system 9 and a boiler 10.

The switchover member 7 further controls a branch 11 which communicates with the shower head 12, of conventional type, which is advantageously arranged on the fixed structure 1.

The outlet duct from the tank 3 communicates with a pump 15, of the gear type which is driven, through an electromagnetic clutch 16, by a driving motor 17 housed inside said fixed structure 1.

On the fixed structure 1 a carriage 20 is able of vertically reciprocating (see in particular FIG. 8) which carriage supports a duct 21 provided with water delivery nozzles 22.

This duct has a closed loop arrangement and the delivery nozzle 22 are advantageously oriented, in a horizontal plane, toward the center of the zone encompassed by the loop duct, which zone is provided for receiving the user.

Figure 7:
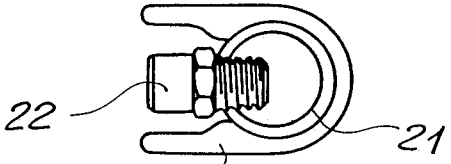
FIG. 7 is a cross-sectional view taken along the line VII—VII of FIG. 3.

As clearly shown in FIG. 7, the duct 21 is housed inside a protection casing, indicated at the reference number 23.

The carriage 20 is provided with a pair of wheels 25, having a fixed axis, said wheels being arranged with an opposite relationship and adjoining swingable wheels 26 which are rotatably supported by brackets 27 pivoted at the middle thereof and resiliently biassed by springs 28, the wheels 25 and 26 sliding on vertically extending rail 29 associated with the fixed frame.

The reciprocating movement of the carriage 20 which, advantageously is made of two like bodies each provided at a respective end of the loop 21, is controlled by a rope 30 entrained on a top driving wheel 31 and an idle bottom wheel 32, on the rope 30 a counterweight being moreover provided, at 33.

The driving wheel or pulley 31 is in turn driven by a helical gear wheel 40 meshing with a worm 41 projecting from a gear assembly 42 driven by the motor 17.

Advantageously, the gear assembly 42 comprises a driving pignon 43 the shaft 44 of which is rigid with the shaft of said motor 17.

The driving pignon 44 meshes with opposite bevel pignons 47 and 48 which are respectively coupled to a first electromagnetic clutch 49 and a second electromagnetic clutch 50 in order to drive the worm 41, in either direction, depending on the carriage movement direction.

On the carriage 20 path there are arranged a top end of stroke limit switch 51 and an intermediate end of stroke limit switch 52 which practically define the displacement range of the carriage 20 and, hence, the movement zone of the loop duct.

A further end of stroke limit switch 53 is moreover provided for setting the lower position of the duct 21, at the end of the water delivery operation.

The apparatus is started by actuating a push-button arranged on the control panel of said apparatus.

As the water in the tank 3 arrives at the desired level, the float member 4 will close the contacts of the microswitch 5, thereby energizing the solenoid valve 6 which, in turn, will shut off the water supply to the tank.

As water is used, the water level in the tank will decrease to a minimum level, which will be sensed by the float member in order to open again the contacts of the microswitch and the solenoid valve to recover the desired water level.

For starting the apparatus, a water supply push-button is further operated, adapted to switch off the carriage driving electromagnetic clutches 49 and 50; this operation will simultaneously operate the electrical motor 17, thereby driving the pump to suck water from the tank.

Thus, because of its pressure, water will pass through the loading valve 60, arranged downstream of the pump, as well as the pressure reduction unit 61, downstream of which there is arranged a pressure monitoring gauge 62 for adjusting the water pressure to a set value.

The pressurized water will arrive at the water delivery nozzle duct and, through the delivery nozzle, it will be caused to impinge against the user body.

In order to obtain the hydromassage effect, a suitable push-button must be operated adapted to switch on the first electromagnetic clutch 49, so as to drive the worm 41 which, through the wheel 40, will drive the rope 30 to cause the carriage to be raised up to the top end of stroke limit switch 51.

As the carriage engages the end of stroke limit switch 51, the first electromagnetic clutch is switched off, while the second electromagnetic clutch is switched on, thereby causing the carriage 20 to be lowered to the intermediate end of stroke limit switch 52, which will drive a further movement reversal, in which the second electromagnetic clutch 50 is switched off while the first electromagnetic clutch 49 is simultaneously switched on.

This movement cycle will be automatically repeated and it can be stopped by the user through the stop push-button which operates so as to switch off the driving command sent by the intermediate end of stroke limit switch, to cause the carriage to descend to the bottom end of stroke switch which, as it is actuated, will switch off both the clutches for stopping the carriage and holding the duct loop at the bottom position.

In this connection it should be pointed out that, as the carriage contacts the top end of stroke limit switch, the electromagnetic clutch 16 is switched off, thereby stopping the pump operation.

From the above disclosure it should be apparent that the invention fully achieves the intended objects.

In particular, it should be pointed out the fact that the apparatus according to the present invention is able of providing, in a complete automatic way, an efficient hydromassage in an even way on the overall body of the user.

While the invention has been disclosed and illustrated with reference to a preferred embodiment thereof, it should be apparent that the disclosed embodiment is susceptible to several modifications and variations all of which will come within the spirit and scope of the appended claims.

I claim:

1. An apparatus for massages comprising a vertical fixed structure to be arranged in a corner zone of a shower room, a water tank supported by said fixed structure including a float member to control a water supply to a water supply duct, a pump communicating with said tank and water supplying said water supply duct, a carriage slidingly supported by said vertical fixed structure to vertically reciprocate thereon, a rope coupled to said carriage, a driving wheel and an idle wheel, said rope being entrained on said driving wheel and idle wheel, a motor coupled to said driving wheel to drive said driving wheel so as to cause said carriage to vertically reciprocate as controlled by said rope, limit switches for controlling said carriage, said carriage supporting a water spraying nozzle duct communicating with said water supply duct through a loading valve, wherein said water spraying nozzle duct includes a plurality space water spraying nozzles arranged in a closed loop pattern oriented toward the center of said closed loop pattern for encompassing a person to be hydromassaged.

2. An apparatus according to claim 1 wherein said plurality of spaced water spraying nozzles are arranged in a common horizontal plane.

* * * * *